US008517372B2

(12) United States Patent
Van Netten

(10) Patent No.: US 8,517,372 B2
(45) Date of Patent: Aug. 27, 2013

(54) SHEET ITEM FEEDER

(75) Inventor: Sjoerd Van Netten, Drachten (NL)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/341,356

(22) Filed: Dec. 30, 2011

(65) Prior Publication Data

US 2012/0175839 A1 Jul. 12, 2012

(30) Foreign Application Priority Data

Dec. 31, 2010 (EP) ..... 10197473

(51) Int. Cl.
*B65H 3/34* (2006.01)
*B65H 7/08* (2006.01)
*B65H 3/52* (2006.01)

(52) U.S. Cl.
USPC ..... 271/104; 271/110; 271/121; 271/137; 271/138

(58) Field of Classification Search
USPC ..... 271/110, 121, 124, 104, 137, 138
See application file for complete search history.

(56) References Cited

U.S. PATENT DOCUMENTS

| | | | | |
|---|---|---|---|---|
| 1,955,066 | A | 4/1934 | Hiller | |
| 2,635,874 | A | 4/1953 | La Bore | |
| 4,666,141 | A * | 5/1987 | Labombarde | 271/35 |
| 5,145,161 | A * | 9/1992 | Bowser et al. | 271/12 |
| 5,203,846 | A * | 4/1993 | Kuhns et al. | 271/125 |
| 5,464,203 | A * | 11/1995 | Bowser et al. | 271/12 |
| 7,419,154 | B2 | 9/2008 | Pelletier et al. | |
| 7,624,978 | B2 | 12/2009 | Kaiping | |
| 2004/0080094 | A1 | 4/2004 | Dopfer | |
| 2007/0138734 | A1 | 6/2007 | Bitner | |
| 2008/0023906 | A1 | 1/2008 | Kaiping | |
| 2008/0157458 | A1 | 7/2008 | Werner | |
| 2009/0134564 | A1 | 5/2009 | Kaiping | |

FOREIGN PATENT DOCUMENTS

| | | | |
|---|---|---|---|
| EP | 1 783 075 | A2 | 10/2006 |
| GB | 2 380 185 | A | 4/2003 |
| JP | 62-215436 | A | 9/1987 |
| JP | 03-056336 | A | 3/1991 |

OTHER PUBLICATIONS

European Search Report of EP 10 19 7473 dated May 26, 2011.

* cited by examiner

*Primary Examiner* — David H Bollinger
(74) *Attorney, Agent, or Firm* — Sughrue Mion, PLLC

(57) ABSTRACT

A feeder for feeding sheet items has at least one circulatable feeding surface for frictionally engaging a sheet item from a stack and at least one separation surface for frictionally engaging the sheet item or an entrained next sheet item from an opposite side. In a lateral direction transverse to the feeding direction, the at least one feeding surface is located between two of the separation surfaces and/or the at least one separating surface is located between two of the feeding surfaces. At least the feeding surface or the separating surface has a resilient zone and a stiff zone more remote from a laterally adjacent separating surface or surfaces or, respectively feeding surface or surfaces than the resilient zone.

5 Claims, 3 Drawing Sheets

SHEET ITEM FEEDER

FIELD AND BACKGROUND OF THE INVENTION

The invention relates to a sheet item feeder comprising:

at least three surfaces consisting of:

at least one circulatable feeding surface of which at least a portion faces in a first direction transverse to the support plane for frictionally engaging a sheet item from the stack and movable in a feeding direction transverse to said first direction in the course of the circulation for exerting traction to that sheet item; and at least one separation surface of which at least a portion faces in a second direction opposite to the first direction for frictionally engaging the sheet item or an entrained next sheet item from the stack;

wherein, in a lateral direction transverse to the feeding direction and to the first and second directions, at least the at least one feeding surface is located between two of the separation surfaces or the at least one separating surface is located between two of the feeding surfaces.

For separating sheets from a stack by exerting traction to the sheets to be separated, several principles of operation are known. In the field of preparation of items to be mailed, in which mostly printed sheets with varying properties have to be processed, two important separation principles that are used are friction separation (also referred to as automatic separation) and gap separation.

In friction separation, a separating surface is typically pressed elastically against a feeding surface. The suspension of the friction coefficient of the separating surface is such that it is entrained with the feeding surface if no sheet material or only a single layer of sheet material is present between the feeding surface and the separating surface. If two sheets are present between the feeding surface and the separating surface, the traction between the separating surface and the nearest sheet is larger than the friction between the two sheets so the nearest sheet, which is in contact with the separating surface, is prevented from being entrained by the moving sheet on the side of the feeding surface.

In gap separation a gap is provided between the feeding surface and the separating surface. The width of the gap is such that only a single sheet at a time is entrained by the friction surface through the gap between the friction surface and the separating surface. If one or more additional sheets are fed to the gap the additional sheet or sheets engage the separating surface which prevents the additional sheet or sheets on the side of the separating surface from being entrained through the gap until the previous single sheet passing through the gap has cleared the gap. The gap may be adjusted so that multi-layered items, such as folded sheets, sheets that are bound to each other or envelopes can be passed through the gap, one at a time only, from a stack of items that are all of generally the same thickness.

Accordingly, in the present context, the term "sheet item" is used to also encompass generally flat, sheetlike items, such as a folded sheet, a booklet, a folder, a cards, an envelope, a carrier carrying a plastic card or a flat data carrier, such as a CD or DVD in a pouch. Where the items are multi-layered, such as envelopes, the layers need to be sufficiently fixed relative to each other to not shift to the extent of being damaged or causing a jam when subjected to oppositely oriented friction forces for feeding and separating.

While ease of use is an important advantage of friction separation, friction separation is relatively unreliable when separating sheet material that is difficult to separate, such as coated ("glossy") sheets that tend to cling to each other or multi-layered sheet items of which the layers can become dislodged relative to each other under influence of opposed traction forced exerted to the layers of a sheet item. On the other hand, while gap separation is more reliable when it comes to separating some types of sheet material that are difficult to separate and multi-layered sheet items, its performance depends heavily on an adequate adjustment of the size of the gap and the need of providing a very fine adjustment for adjusting the size of the gap complicates the design of such separating mechanisms.

In U.S. Pat. No. 2,635,874 an apparatus of the initially identified type is disclosed. In this sheet item feeder, the feeding and separating surfaces, constituted by circumferential surfaces of feeding and separating rollers, are not arranged opposite of each other, but staggered in lateral direction transverse to the feeding direction. This causes sheets passing between the rollers to be bent to some extent into a pattern that is wavy in lateral direction. Because the sheets do not pass between a gap between the feeding rollers and the separating rollers, such separating mechanisms are less sensitive to a precise adjustment of the positions of the feeding and separating surfaces. However, the performance of such systems nevertheless depends on adequately adjusting the positions of the feeding and separating surfaces to the stiffness of the sheet material, both laterally and in directions transverse to the plane in which the sheets are transported.

In the apparatus disclosed in U.S. Pat. No. 2,635,874, the sensitivity to adjustment of the relative positions of the feeding surfaces and the separating surfaces is reduced by providing that a spring loaded mechanism urges separating rollers against stationary surfaces opposite of the separating rollers so that the counter force resisting sheets from being entrained is exerted between the separating rollers and a counter surface. A disadvantage of such a system is that it is relatively complicated and that a sheet to be fed also encounters resistance from the stationary counter surface against which it is pressed by the pressure exerted by the separating rollers.

SUMMARY OF THE INVENTION

It is an object of the present invention to provide a simple separating system that reliably separates sheets of a wide range of thicknesses and stiffnesses as well as sheet material that is difficult to separate.

According to the invention, this object is achieved by providing a sheet item feeder comprising:

at least three surfaces consisting of:

at least one circulatable feeding surface of which at least a portion faces in a first direction transverse to the support plane for frictionally engaging a sheet item from the stack and movable in a feeding direction transverse to said first direction in the course of the circulation for exerting traction to that sheet item; and at least one separation surface of which at least a portion faces in a second direction opposite to the first direction for frictionally engaging the sheet item or an entrained next sheet item from the stack;

wherein, in a lateral direction transverse to the feeding direction and to the first and second directions, at least the at least one feeding surface is located between two of the separation surfaces or the at least one separating surface is located between two of the feeding surfaces;

wherein at least the feeding surface or the separating surface has a resilient zone laterally adjacent to the separating surface or at least one of the separating surface or, respectively, the feeding surface or at least one of the feeding surfaces, the resilient zone being more resilient than a stiff zone of the feeding surface or, respectively, the separating surface more remote from the laterally adjacent separating surface or surfaces or, respectively feeding surface or surfaces than the resilient zone.

By providing that at least the feeding surface or the separating surface has a resilient zone laterally adjacent of a separating surface or, respectively, feeding surface, at least the feeding surface or, respectively, the separating surface is capable of accommodating to the thickness and the stiffness of the sheet or sheets being separated and fed, so the sensitivity of the separating mechanism to differences in the thickness and the stiffness of sheets is reduced. Because the resilience is integrated in the feeding member or the separating member, the proposed solution can be implemented without requiring a complicated costly construction.

Further features, effects and details of the invention appear from the detailed description and the drawings.

DETAILED DESCRIPTION

Figure 1:
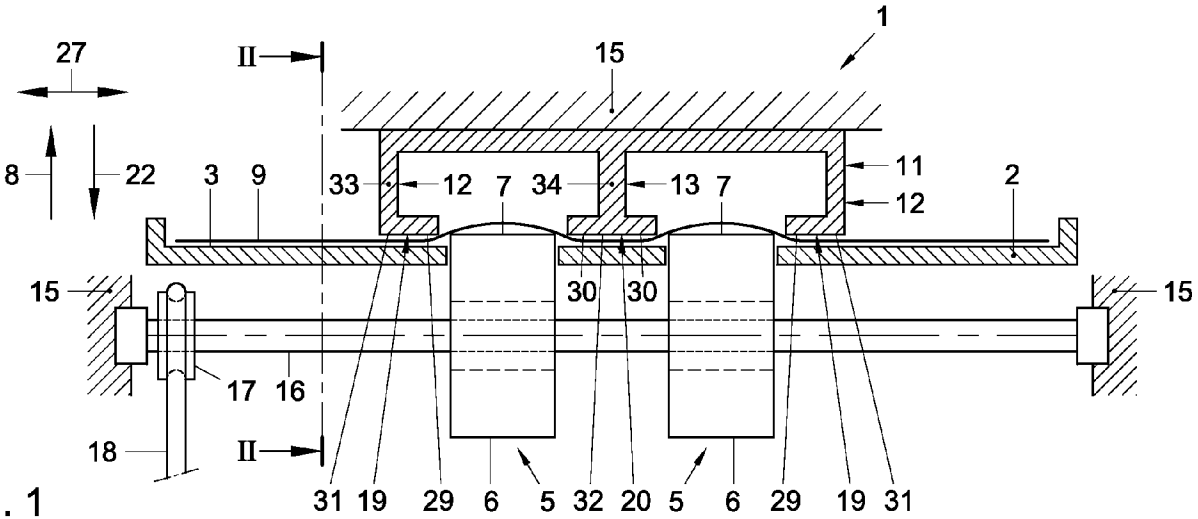
FIG. 1 is a schematic, cross-sectional frontal view of a first example of a sheet feeder according to the invention.

The invention is first described with reference to the example shown in FIGS. 1 and 2. According to this example, a sheet feeder 1 has a support 2 defining a support plane 3 for supporting a stack of sheets 4 (see FIG. 2).

The sheet feeder 1 further has circulatable feeding members in the form of feeding rollers 5 that each have a circumferential feeding surface 6 of which a portion 7 faces in a first direction 8 transverse to the support plane 3 for frictionally engaging a sheet 9 from the stack 4. The feeding rollers 5 are fixed to a shaft 16 that is rotationally suspended to a frame 15. For driving rotation of the shaft 16 and the feeding rollers 5, a pulley 17 about which a drive belt 18 is tensioned is fixed to the shaft 16. Circulation of the drive belt 18 can for instance be driven by a motor via a pulley coupled directly or indirectly (for instance via a clutch) to an output shaft of the motor (not shown).

By rotating the rollers 5 in a feeding sense of rotation 10, the portions 7 of the circumferential feeding surfaces 6 that face in the first direction 8 are movable in a feeding direction 28 transverse to the first direction 8 in the course of the circulation for exerting traction to the sheet 9 frictionally engaged by the feeding rollers 6.

For separating succeeding sheets 23 from a sheet 9 to be fed, the sheet feeder 1 has a separating unit 11 with three separating members 12, 13. The separating members 12, 13 each have a separation surface 19, 20 that faces in a second direction 22 opposite to the first direction 8 for frictionally engaging the sheet 9 or an entrained next sheet from the stack 4. The separating unit 11 is fixedly mounted to the frame 15 of the sheet feeder 1.

In a lateral direction 27 transverse to the feeding direction 28 and to the first and second directions 8, 22, the feeding surfaces 6 are each located between two of the separation surfaces 19, 20 and a central one of the separating surfaces 20 is located between two feeding surfaces 6.

Figure 2:
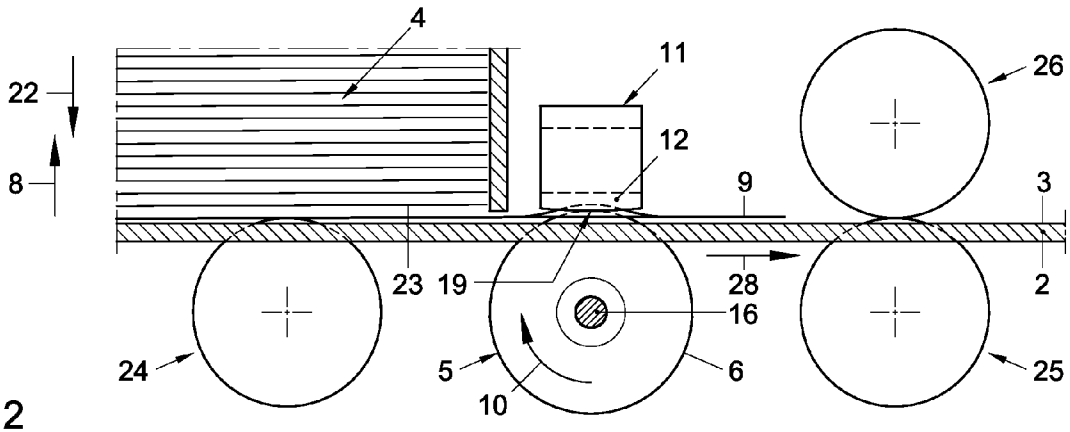
FIG. 2 is a cross-sectional view along the line II-II in FIG. 1.

As is best seen in FIG. 1, a sheet 9 being fed and separated is bent to some extent into a wavy pattern in lateral direction 27. Because the sheet does not pass between a gap between a feeding surface and a separating surface, the separating mechanism is relatively insensitive to a precise adjustment of the positions of the feeding and separating surfaces 6, 12, 13.

For supplying sheets from the stack 4 to the feeding surface 6 and the separating surfaces 19-21, a supply roller 24 drivable in the feeding sense of rotation 10 is provided. A portion of the circumference of the supply roller projects upwardly of the support plane 3 for frictionally engaging a lowermost sheet 9 of the stack 4. Downstream of the feeding surface 6 and the separating surfaces 19-21, transport rollers 25, 26 drivable in the feeding sense of rotation 10 are provided. Sensors and a control structure can be provided for controlling rotation of the transport rollers 25, 26, for instance for stopping a partially separated sheet in a starting position and transporting the sheet further in response to a command signal for transporting the sheet to a next location.

The separating surfaces 12, 13 each have a resilient zone 29, 30 laterally adjacent of a laterally adjacent feeding surface 6. The resilient zones 29, 30 are more resilient than stiff zones 31, 32 of the respective separating surfaces 12, 13 more remote from the laterally adjacent feeding surface 6 than the respective resilient zone 29, 30.

Because the resilient zones are more resilient than the respective stiff zones of the separating surfaces more remote from the laterally adjacent feeding surface than the resilient zone, the sensitivity of the separating mechanism to differences in the thickness and the stiffness of sheets is reduced. Because the resilience is integrated in the separating member, the construction is simple and can be manufactured at low costs.

In the present example, the feeding surfaces 6 are located outside areas opposite the separating surfaces 19, 20 only. This leaves room for the paper to deflect and is advantageous for reducing sensitivity to differences of the thickness of the sheets to be processed. However, in particular if the resilient zones 29, 30 are very resilient, an overlap in lateral direction between the feeding surfaces 6 and the separating surfaces 19, 20 can be advantageous for improving grip without overly sacrificing versatility with respect to the range of paper thicknesses that can be processed. Preferably, a lateral clearance smaller than 3 mm and more preferably smaller than 2 mm is provided between laterally adjacent feeding and separating surfaces. The lateral positions of the feeding and/or separating surfaces may be adjustable for adjusting the overlap and/or the clearance between laterally adjacent surfaces.

The separating unit 11 is manufactured in the form of an integrally formed piece of (preferably rubber) material, so a plurality of separating members can be manufactured and installed in a simple and low-cost manner.

In the sheet feeder according to the present example, the resilient zones 29, 30 are obtained in a simple manner and can be provided with a large extent of resilience, because the resilient zones are each part of a flange projecting in the lateral direction 27 from a support portion 33, 34 of the separating member 12, 13. Thus, the resilience of the laterally outer zones is achieved by the relatively thin walled configuration of the flanges. This allows the resilient zones to be resiliently displaced over a relatively large distance in a manner similar to a leaf spring, while the specific deformation of the material of the flanges remains relatively small. This in turn allows to achieve a desired degree of resilience with relatively hard material, which is in turn advantageous for keeping wear low, since hard materials are generally more wear resistant than soft materials.

For effectively accommodating to differences in thickness and stiffness of the sheets processed it is preferred that, as in the present example, the resilient zones 29, 30 are more resilient than the respective stiff zones 31, 32 in the first or second direction 8, 22, i.e. in a direction transverse to the sheet 9 being fed and separated. However, also resilience in lateral direction can contribute significantly to accommodating to differences in thickness and stiffness of the sheets processed.

Figure 3:
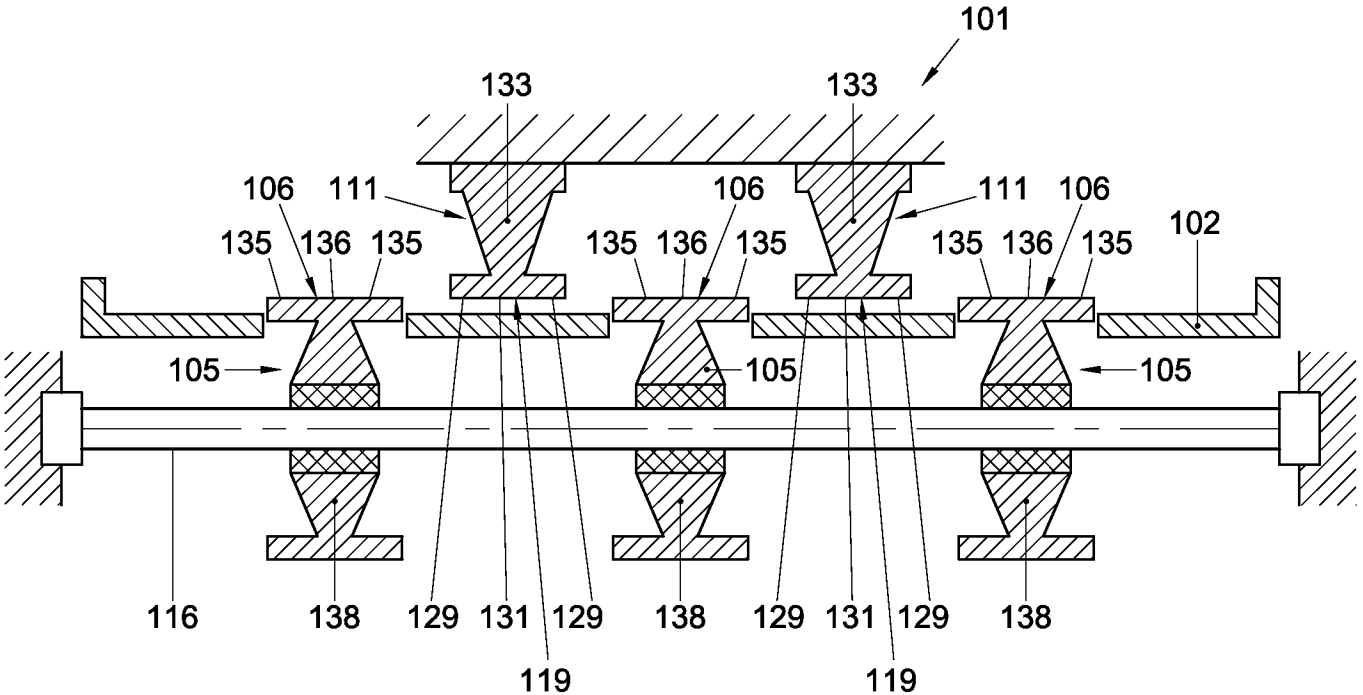
FIG. 3 is a schematic, cross-sectional frontal view of a second example of a sheet feeder according to the invention.

In the example of a separator 101 shown in FIG. 3, three feeding rollers 105 are provided. Each of these feeding rollers 105 has a circumferential feeding surface 106, which has resilient outer zones 135 and a stiff central zone 136. The outer zones 135 are more resilient than the central zones 136 because the outer zones are formed by surface portions of laterally distal portions of flanges laterally projecting from a central disk portion 138 of the respective feeding roller 105. Since the relatively thin walled flanges can be bent inwardly relatively easily, the laterally distal portions of these flanges are resilient in radially inward direction. According to the present example, these disk portions 138 have a thickness which decreases in radially outward direction from a hub via which the roller 105 is mounted to an axle 116, so the disk portions 138 are thickest where the loads to which the disk portions are subjected are largest. This keeps the flanges positioned accurately in lateral direction, which does in turn allow the feeding rollers 105 to be mounted with relatively small clearances in lateral direction relative to separating surfaces 119 of separating members 111 and relative to openings in guide 102. A similar effect may also be achieved by providing the central portions in thin walled form with support flanges extending radially and projecting laterally.

The separating members 111 are fixed to the frame 115 from which the axle 116 is rotatably suspended so that, in lateral direction each separating member 111 is located between two directly adjacent feeding rollers 105. In a direction generally perpendicular to the feeding and separating surfaces, the distance between the feeding surfaces and the separating surfaces, or to a lateral continuation thereof, is preferably smaller than the thickness of the thinnest sheet to be processed, e.g. thinner than 0.06 mm and more preferably the distance between the feeding surfaces and a lateral continuation of the separating surface is zero or it is provided that the feeding rollers project slightly beyond the separating surfaces 119, preferably over a distance smaller than 3 mm and, more preferably, over a distance smaller than 1.5 mm. The relative positions of the feeding and the separating surfaces in a direction generally perpendicular to the feeding and separating surfaces may also be adjustable to be able to separate sheet items of more widely varying thickness and stiffness (the items to be separated in the stack having generally identical thicknesses and stiffnesses), for instance ranging from items of thick plate material to items of flexible plastic material. The separating members 111 each have flanges extending laterally from support portions 133. Like the disk portions 138 of the feeding rollers 105, the support portions of the separating members 111 each have a thickness that decreases from a base side towards the flanges, so that also the flanges of the support members are maintained accurately positioned in lateral directions, even when subjected to lateral loads, while the flanges project laterally over a sufficiently large distance to allow the free end zones thereof to be deflected away from the feeding rollers 105 in response to loads exerted thereon by paper passing between the feeding rollers 105 and the support members 111. The separating surface portions 119 of the separating members, which face the axle 116, have laterally outer zones 129 that are more resilient than stiff central zones 131.

In the separator according to this example resilient outer zones 129, 135 of both the feeding surfaces 106 and the separating surfaces 119 both contribute to providing an improved accommodation to differences in stiffness and thickness of material that is urged into a more or less pronounced wavy pattern as it is passed between the feeding rollers 105 and the separating members 111.

Figure 4:
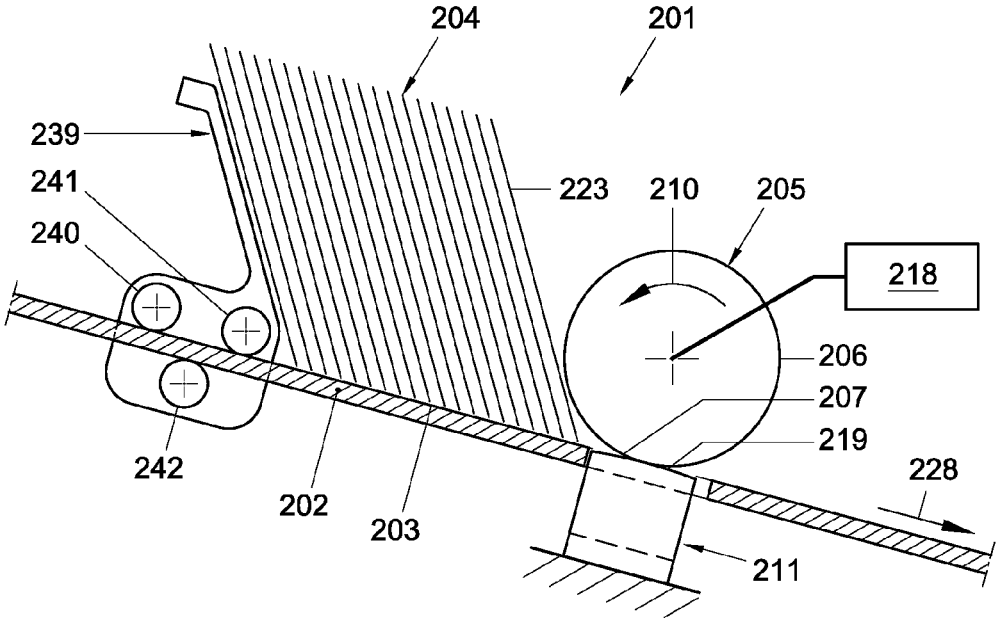
FIG. 4 is a cross-sectional side view of an implementation of a third example of a sheet feeder according to the present invention.

In the example of an implementation of a separator 201 according to the invention shown in FIG. 4, the sheets 204 to be separated are supported on edge on a platform 202. An end support 239 has rollers 240-242 on opposite sides of the platform for guiding the end support 239 along the platform 202 towards and away from feeding rollers 205 and a separating member 211, while keeping the end support 239 oriented relative to the platform 202 such that a face of the end support 239 facing the sheets 204 is maintained at a generally fixed oblique angle relative to the platform 202.

Separating surfaces 219 of the separating member 211 and an oppositely facing segment 207 of the circumferential surface 206 of the feeding roller 205 are generally in line with an upper surface 203 of the platform 202, on which surface 203 the edges of the sheets 204 rest. The feeding roller 205 is coupled to a drive 218 (shown schematically only) for driving rotation of the feeding roller 205 in a sense of rotation 210, such that the segment 207 of the circumferential surface 206 of the feeding roller 205 facing in a direction opposite to the separating surfaces 219 and the upper face 203 of the platform 202 moves generally in a feeding direction 228 along the platform and away from the stack of sheets 204.

An outer one 223 of the sheets 204 is in contact with the circumferential surface 206 of the feeding roller 205, since the stack is urged towards the feeding roller 205 by gravity, which effect is enhanced by the weight of the end support 239. Alternatively, or in addition, the end support may also be urged against the stack by other means, such as a spring, a motor or gravity acting on a weight coupled to the end support via a string or a lever. Since the outer one 223 of the sheets 204 is in contact with the circumferential surface 206 of the feeding roller 205, the feeding roller 205 also provides for the supply of sheets towards the separating area where the separating surfaces 219 and the oppositely facing segment or segments 207 of the circumference 206 of the feeding roller 205 are located. Thus, no separate rollers and drive is necessary for supplying sheets to the separating area. A separator as shown in FIG. 4 is particularly suitable for separating relatively stiff sheets, such as business reply cards and envelopes.

Within the framework of the invention as defined by the claims, many other embodiments and variants are conceivable. For instance, instead of a surface on a stationary separating member, the separating surface can be a circumferential surface of a circulatable member such as a roller or a belt. The circulatability of the separation surface may for instance be employed to allow the separation surface to be entrained if only a single sheet item passes between the separation and feeding surfaces. Circulating the separation surface may also be carried out only to bring a fresh portion or fresh portions of separation surface in the operating area near to the feeding surface or surfaces. For that purpose the circulatability in the operating area near the feeding surface or surfaces does not have to be in a direction parallel to the feeding direction of sheet items being separated and fed, but may for instance be perpendicular to that direction.

Furthermore, the suspension of the separating and/or feeding members may be essentially rigid or resilient, the latter option allowing the mutual positions of the feeding and separating surfaces to accommodate to the processing of sheet items of widely varying stiffness and/or thickness.

If, as described, the relative positions of the feeding and separating surfaces are adjustable laterally and/or in directions generally perpendicular to the feeding and separating surfaces, for automatic adjustment the feeder may be equipped with one or more sensors for measuring flexural deformation of a sheet item between the feeding and separating surfaces and a controller connected to the sensor or sensors for receiving a signal representing the measured flexural deformation. If the controller is then arranged for adjusting the relative positions of the feeding and separating surfaces in response and in accordance with the signal representing the measured flexural deformation, the adjustment of the relative positions of the feeding and separating surfaces can be carried out automatically, without resorting to measuring the thickness and or stiffness of the sheet items to be separated. The sensors may for instance be hall sensors or optical sensors as described in European patent application 2 085 743.

The invention claimed is:

1. A sheet item feeder comprising:

at least three surfaces consisting of:

at least one circulatable feeding surface of which at least a portion faces in a first direction transverse to the support plane for frictionally engaging a sheet item from the stack and movable in a feeding direction transverse to said first direction in the course of the circulation for exerting traction to that sheet item; and at least one separation surface of which at least a portion faces in a second direction opposite to the first direction for frictionally engaging the sheet item or an entrained next sheet item from the stack;

wherein, in a lateral direction transverse to the feeding direction and to the first and second directions, at least the at least one feeding surface is located between two of the separation surfaces or the at least one separating surface is located between two of the feeding surfaces;

wherein at least the feeding surface or the separating surface has a resilient zone laterally adjacent to the separating surface or at least one of the separating surfaces or, respectively, the feeding surface or at least one of the feeding surfaces, the resilient zone being more resilient than a stiff zone of the feeding surface or, respectively, the separating surface more remote from the laterally adjacent separating surface or surfaces or, respectively feeding surface or surfaces than the resilient zone.

2. A feeder according to claim 1, wherein the at least one feeding surface is located laterally outside areas directly opposite the at least one separating surface only.

3. A feeder according to claim 1, wherein the resilient zone is part of a flange projecting in a lateral direction from a support portion of the feeding member or, respectively, the separating member.

4. A feeder according to claim 1, wherein the resilient zone is more resilient than the stiff zone in the first or second direction.

5. A feeder according to claim 1, wherein relative positions of the feeding and separating surfaces are adjustable, the feeder further comprising at least one sensor arranged for measuring flexural deformation of a sheet item between the feeding and separating surfaces and a controller connected to the at least one sensor for receiving a signal representing the measured flexural deformation, the controller being arranged for adjusting the relative positions of the feeding and separating surfaces in response and in accordance with the signal representing the measured flexural deformation.

* * * * *